United States Patent [19]

Montoya

[11] Patent Number: 4,910,501

[45] Date of Patent: Mar. 20, 1990

[54] CREOSOTE FIRE ALARM SYSTEM

[76] Inventor: Ray A. Montoya, 1804 32nd St., SE., Rio Rancho, N. Mex. 87124

[21] Appl. No.: 233,018

[22] Filed: Aug. 17, 1988

[51] Int. Cl.[4] ..... G08B 17/12

[52] U.S. Cl. ..... 340/578; 250/200; 250/554; 250/574; 250/237 R; 340/577; 340/522; 340/588; 340/589; 340/586; 340/630

[58] Field of Search ..... 340/578, 577, 520–522, 340/588, 589, 584, 596, 586, 630; 250/200, 554, 574, 237 R

[56] References Cited

U.S. PATENT DOCUMENTS

| | | | |
|---|---|---|---|
| 4,315,256 | 2/1982 | Dennis | 340/584 |
| 4,378,555 | 3/1983 | Johnson et al. | 340/588 |
| 4,389,124 | 6/1983 | Longenecker | 73/183 |
| 4,433,923 | 2/1984 | Rascati et al. | 340/584 |
| 4,463,346 | 7/1984 | Bates | 340/540 |
| 4,486,743 | 12/1984 | Brown | 340/584 |
| 4,568,923 | 2/1986 | Ouchi | 340/584 |
| 4,712,095 | 12/1987 | Georgis, II | 340/584 |

*Primary Examiner*—Donnie L. Crosland
*Attorney, Agent, or Firm*—Robert W. Harris

[57] ABSTRACT

An alarm system for warning of a creosote chimney fire hazard, having both means to produce a visible alarm when the creosote temperature is nearing the creosote flash point, and means to produce an audible alarm when light from actual ignition of a creosote fire is detected. The invention also provides means to discriminate against detection of wood fire light, to minimize false alarms.

15 Claims, 2 Drawing Sheets

CREOSOTE FIRE ALARM SYSTEM

BACKGROUND OF THE INVENTION

The invention pertains to alarm systems for warning the owner of a residence or other building containing a fireplace with a chimney, as to the hazard of a possible chimney fire caused by ignition of creosote progressively deposited over time on the chimney walls as a wood fire combustion product. Such creosote fires are often difficult to extinguish, and burn at a high temperature, which may exceed the chimney design limits, and thereby cause a general conflagration in wood frame members of the surrounding structure.

Although it is known to use a temperature sensor in a chimney to monitor a chimney fire hazard, the present invention offers means to directly detect light from a creosote fire, distinguished from the wood fire light, and to produce a corresponding alarm signal. In one form the invention also offers means to detect when the creosote temperature has reached a warning temperature nearing the creosote ignition temperature, and to produce a different warning signal when said warning temperature has been reached, as a preliminary warning signal.

SUMMARY OF THE INVENTION

There is provided within the chimney a sensor means of simple form (a photocell in the preferred embodiment), for detecting creosote fire light, as well as means for discriminating against detection of wood fire light. In one form of the invention an additional simple sensor means (a thermistor in the preferred embodiment) is provided within the chimney, for detecting when the creosote temperature has reached a predetermined warning temperature nearing the ignition temperature of the creosote. Although the term "chimney" shall be generally used herein to refer to the location of a possible creosote fire, and to the site for placement of the sensors, it should be understood that the invention may also be employed to warn of a creosote fire hazard arising from the operation of a wood stove, in which case the corresponding site would be the stove pipe.

Circuit means are also provided, having portions electronically connected to each sensor means, for producing electrical signals which may be used to activate alarm devices emitting different audible or visible alarm signals, when the creosote temperature has reached the warning temperature, and when the creosote fire light has been detected upon ignition of a creosote chimney fire.

It is a purpose of the present invention to provide an inexpensive, easily and inexpensively manufactured creosote fire alarm system, which may in its various embodiments accomplish the following purposes:

(1) providing a reliable indication of creosote fire ignition by detection of creosote fire light;

(2) prevention of false alarm signals in detecting creosote fire light, by discriminating against detection of wood fire light;

(3) providing advance warning of possible creosote fire ignition, and consequent hazard alarm redundancy, by providing an alarm signal when the creosote temperature reaches the predetermined warning temperature, before actual ignition of a creosote fire;

(4) providing such a system which may be easily installed by a homeowner with a minimum of tools and equipment;

(5) providing a system with circuits and alarms which may, if desired, be operated at a distance remote from said chimney;

(6) providing a system such that those components which must operate in the environment of hot chimney effluent may operate over an extended period of time, without incapacitating damage; and (7) providing a system with a sensor assembly which is readily removable from the chimney, for periodic cleaning.

BRIEF DESCRIPTION OF THE DRAWINGS

The invention may be better understood by reference to the illustrative but not limiting preferred embodiments illustrated by the accompanying drawings, in which.

DESCRIPTION OF THE PREFERRED EMBODIMENTS

Figure 1:
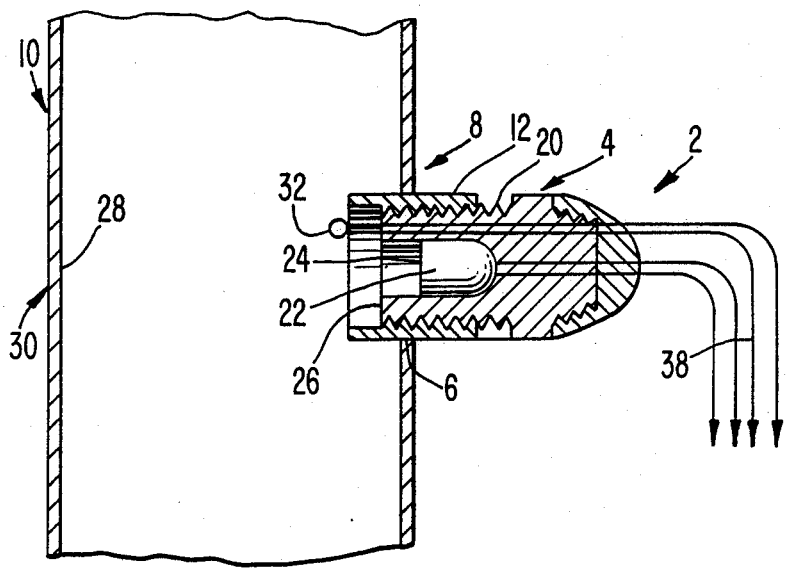
FIG. 1 is an elevational cross section of the chimney and the attached sensor assembly.
Figure 4:
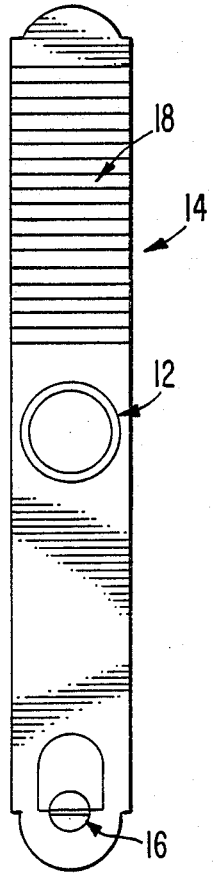
FIG. 4 is a plan view of the strap and coupling unit used to secure the sensor assembly to the chimney.

Referring now to the drawings, in which like reference numbers denote like or corresponding parts, the sensor assembly is shown in FIG. 1. Sensor assembly 2 comprises: (1) a cylindrical sensor housing 4 which is inserted through a hole 6 in one side wall 8 of chimney 10; (2) the two sensors described below; and (3) means for securing sensor housing 4 to side wall 8 of chimney 10.

Numerous convenient alternative means may be employed to secure sensor housing 4 to side wall 8. For example, a tubular coupling 12, which is a short section of cylindrical metal tubing sized to fit hole 6 in chimney side wall 8 in a snug fit engagement, is secured to chimney 10 by means of a metal strap 14 welded to the outside of the mid portion of coupling 12 (strap 14 being perpendicular to the axis of coupling 12 at the juncture of strap 14 and coupling 12), which strap 14 is wrapped around chimney 10 in a horizontal plane. The outer ends of strap 14 are secured to one another by means of a screw lock mechanism comprising a screw 16 passing through one end of strap 14, and a series of parallel notches 18 in the other end of strap 14, any one of which may be engaged by screw 16, so that strap 14 may be secured to chimneys 10 of various sizes. Alternatively, a suitable latching mechanism could be used to secure the two ends of strap 14 to one another. Sensor housing 4 has threads 20 on the outside thereof, which engage corresponding threads on the interior wall of coupling 12. Coupling 12 is secured to chimney 10 as described above, with equal portions of the length of coupling 12 (total length 1½") projecting into hole 6 and outside of hole 6. Sensor housing 4 is screwed into coupling 12, with a portion of sensor housing 4 projecting into the interior of chimney 10. With this structure sensor assembly 2 is readily removable for annual cleaning.

Sensor housing 4 contains a photocell 22, inserted with its photosensitive surface 24 facing the interior of chimney 10, which is the means for detecting creosote fire light. A cadmium sulfide photocell (200V peak max. AC or DC applied voltage, typical resistance 15K ohms±40%) may conveniently be employed for photocell 22. With conventional photocells, sensor housing 4 should be sealed to protect photocell 22 from possibly harmful effects which could be caused by long term exposure to hot chimney effluents; yet the means employed for such sealing must allow creosote fire light to freely enter sensor housing 4 in order to reach the photosensitive surface 24 of the photocell 22. Such sealing may conveniently be accomplished by means of potting and encapsulating materials, using materials resistant to high temperatures, such as clear Kynar (made by the Raychem Co.), high temperature tubing, and fire resistant Sylgard 170 silicone elastomer (Dow Corning Co.).

The interior end 26 of sensor housing 4 projects into the chimney 10 for a distance sufficiently far beyond photosensitive surface 24 of photocell 22 so as to block any direct line of sight by which light from the wood fire at the base of chimney 10 might otherwise be able to reach photosensitive surface 24 of photocell 22.

This geometry allows photocell 22 to detect creosote fire light, e.g., from creosote burning upon the portion 28 of chimney wall 30 directly opposite from photosensitive surface 24, while minimizing the possibility of false alarms from detection of normal wood fire light. Although some wood fire light will reach photosensitive surface 24 by scattering from portion 28 of chimney wall 30, the reflectivity of this normally blackened surface will be low, and this problem may also be dealt with by appropriate selection and adjustment of the detection sensitivity of photocell 22. Such photocells are available with various light sensitivity curves. The circuit described below offers an additional means for adjusting the detection sensitivity of photocell 22, to prevent any wood fire light false alarm problem, as further discussed below.

Completing sensor assembly 2 is a thermistor 32 attached to the interior of sensor housing 4, within chimney 10, projecting about an inch forward (toward the chimney interior) of the interior end 26 of sensor housing 4. Thermistor 32 is, as shown in FIG. 1, projecting into chimney 10 just above photocell 22, and does not block ingress of light of photosensitive surface 24 of photocell 22. In this position thermistor 32 is able to sense the temperature of the creosote deposited on the interior walls of chimney 10. For thermistor 32 one may conveniently use a generic high precision thermistor, having a 10K ohm resistance at room temperature, and a temperature sensing range from −50 degrees C. to +110 degrees C. (−58 degrees F. to +230 degrees F.). Potentiometer 36 (see FIG. 2) may be used to adjust the temperature sensitivity of thermistor 32 by extending the upper end of the effective temperature range of thermistor 32 to approximately 550–600 degrees F. Thermistor 32 may conveniently be attached to the interior of sensor housing 4 by means of potting and encapsulating material using a sealant and adhesive such as Dow Corning 732.

Photocell 22 and thermistor 32 are electronically connected with the circuits described below, by means of control wiring 38, which is high temperature wire (at least in the vicinity of sensor assembly 2). A wire such as AWG #14 solid copper standard insulation wire (e.g., Raychem Co.) may be used, further protected from high temperature, abrasion and insulation breakdown by heat shrinkable tubing (e.g., Raychem Co. type DR-25 tubing, which is quite flame resistant). By means of control wiring 38 the circuits and alarms described below may, if desired, be located at a positions remote from chimney 10, where they would not be exposed to the high temperatures which envelop sensor assembly 2.

Figure 2:
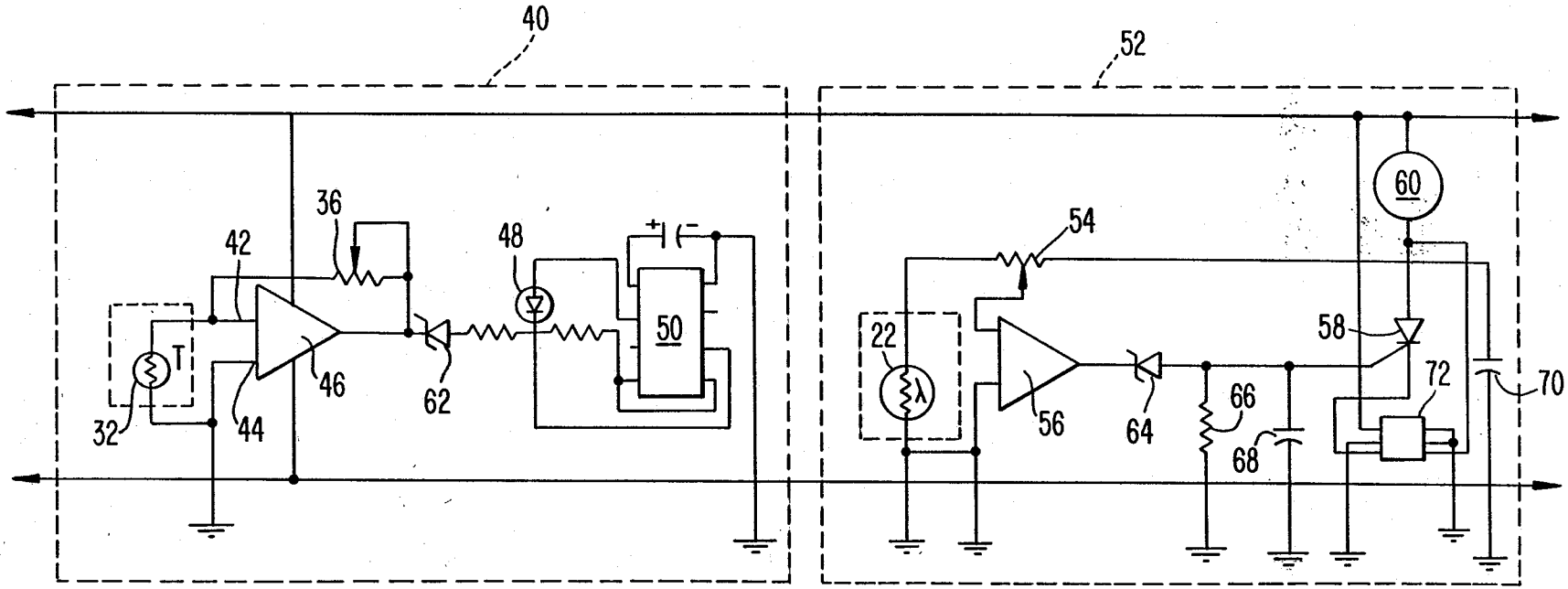
FIG. 2 is a schematic of the circuit means, showing on the left side the temperature circuit portion of the circuit means, which activates an LED warning signal light when the thermistor senses that the creosote in the chimney has reached the warning temperature; and on the right side the portion of the circuit means which activates an audible alarm device when the photocell has detected creosote fire light.

The circuit means has two principal portions, which may for convenience be contained within a common housing, and which are schematically shown in FIG. 2. For the first warning, that the creosote temperature has reached the warning temperature (550 degrees F.) nearing the creosote flash point (650 degrees F.), the temperature circuit means of the left side 40 of FIG. 2 is employed, in which thermistor 32 is electronically connected to the input terminals 42 and 44 of operational amplifier 46.

The output of amplifier 46 is applied to an LED 48, by means of an LED flasher/oscillator (LED flasher IC) 50, in order to give a visible alarm signal when the warning temperature has been reached. Of course, an audible alarm such as a buzzer could instead be used, without departing from the substance of the invention.

The other portion of the circuit means, which processes the signal from photocell 22, is shown schematically on the right side 52 of FIG. 2. Photocell 22 is connected to a 1 Meg potentiometer 54, the center tap of which provides the input voltage to operational amplifier 56. The output from amplifier 56 is applied to an SCR transistor 58, which controls operation of an audible alarm buzzer 60. Potentiometer 54 may be used to adjust the detection sensitivity of photocell 22, by acting as a voltage divider adjusting the amount of current between the invert input and non-invert input of operational amplifier 56, thus regulating the voltage and current which powers up operational amplifier 56 and operates the entire circuit. This adjustment of detection sensitivity offers an additional means whereby photocell 22 may detect creosote fire light, while discriminating against false alarms due to detection of wood fire light or indirect sunlight entering chimney 10. The function of zener diodes 62 and 64 is to be a reference potential as a source of constant DC voltage or stabilizing the DC voltage from the output of the amplifier, while allowing the amplifier output to pass through the zener diode to the rest of the circuit. A 330 ohm resistor 66 and 0.033 microfarad capacitor 68 are used for filtering, to smooth out the DC voltage and current gain from the operational amplifier 56, before it triggers the gate of SCR transistor 58, thus improving the switching operation of SCR transistor 58 and allowing a faster response time. A 0.015 microfarad capacitor 70 protects SCR transistor 58 from over-current in both the switching and normal circuit modes. A switch 72 is used both for testing of the circuit and also to enable the circuit for normal operation.

Figure 3:
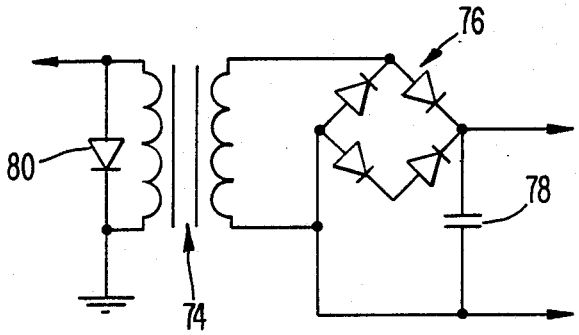
FIG. 3 is a schematic of one form of DC power supply which may conveniently be used in operation of the preferred embodiments.

FIG. 3 schematically illustrates one form of DC power supply used to provide DC voltage for operation of the circuits described above. The power supply has a 110 volt AC primary, 12.6 AC volt secondary control transformer 74, the secondary of which is connected to a 6 amp 50 PIV (power inverse voltage) full wave bridge rectifier 76. A 100 microfarad capacitor 78, connected across the output of rectifier 76, is used to smooth out the DC output voltage. An AC surge absorber 80 may be connected across the primary of control transformer 74, for additional protection against spikes in the AC power line voltage.

A C & K ss series solid state push button switch will be used in both the audible and visible alarm circuits. This type of switch is a momentary single pole double throw switch. This switch contains a built-in custom integrated circuit and provides all of the clearing functions necessary to interface the switch directly to the audible and visible alarm circuits. The I.C. also supplies regulated current to a built-in LED display. Therefore, when the user turns on the system the LED display on the switch will turn on a light-up giving an "on" indication to the user. This "on" indication would also indicate the system is operating properly. The user may test the system by depressing the switch momentarily operating the audible alarm.

Those familiar with the art will appreciate that the present invention may be employed in numerous alternative embodiments other than expressly disclosed herein, without departing from the substance of the invention. The essential characteristics of the invention are defined by the following claims.

I claim:

1. Creosote fire alarm system, for alerting a person to the hazard of a creosote fire in creosote deposited within a chimney, which creosote fire may be caused by heat from a wood fire within said chimney, comprising:

(a) sensor and circuit means having an electrical output terminal, for:
  (1) detecting light from said creosote fire;
  (2) discriminating against detection of light from said wood fire; and
  (3) producing an amplified electrical signal at said output terminal, when said light from said creosote fire has been detected;

(b) alarm means, electronically connected to said output terminal of said sensor and circuit means, for producing an alarm signal readily perceptible to said person when said light from said creosote fire is detected by said sensor and circuit means.

2. Creosote fire alarm system as in claim 1, in which said sensor and circuit means further comprises temperature-responsive means, having an electrical output terminal, for detecting when said creosote in said chimney has reached a predetermined warning temperature, and for producing an amplified electrical signal at said electrical output terminal of said temperature-responsive means, when said creosote has reached said warning temperature; and wherein said alarm means further comprises means electronically connected to said output terminal of said temperature-responsive means, for producing an alarm signal readily perceptible to said person when said creosote has reached said warning temperature.

3. Creosote fire alarm system, for alerting a person to the hazard of a creosote fire in creosote deposited within chimney, which may be caused by heat from a wood fire within said chimney, comprising:

(a) sensor assembly, comprising:
  (1) sensor housing;
  (2) means, for connecting said sensor housing to said chimney and for securing said sensor housing to said chimney in such position such that at least a portion of said sensor housing is within said chimney;
  (3) creosote fire light sensor means, secured to said sensor housing, for sensing said light from said creosote fire;
  (4) means, disposed between said wood fire and said creosote fire light sensor means, for blocking any direct path for light from said wood fire to said creosote fire light sensor means, so as to allow said creosote fire light sensor means to detect said light from said creosote fire while discriminating against detection of said light from said wood fire;

(b) circuit means, having input and output terminals, having said input terminal electronically connected to said creosote fire light sensor means, for detecting when said creosote fire light sensor means has sensed said light from said creosote fire, and for allowing control of the detection sensitivity of said circuit means so as to further allow said circuit means to detect said light from said creosote fire while discriminating against detection of said light from said wood fire, and for producing an amplified electrical signal at said output terminal when said creosote fire light sensor means senses said light from said creosote fire;

(c) alarm means, electronically connected to said output terminal of said circuit means, for producing an alarm signal readily perceptible to said person when said light from said creosote fire is sensed by said creosote fire light sensor means.

4. Creosote fire alarm system as in claim 3, in which said sensor assembly further comprises a creosote temperature sensor means, secured to said sensor housing within said chimney, for sensing when said creosote temperature reaches a predetermined warning temperature; and wherein said circuit means further comprises a temperature circuit means, having input and output terminals, having said input terminal electronically connected to said creosote temperature sensor means, for detecting when said creosote temperature reaches said warning temperature, and for producing an electrical signal at said output terminal of said temperature circuit means when said creosote temperature reaches said warning temperature; and wherein said alarm means further comprises a warning temperature alarm means, electronically connected to said output terminal of said temperature circuit means, for producing an alarm signal readily perceptible to said person when said creosote temperature reaches said warning temperature.

5. Creosote fire alarm system as in any one of the preceding claims, in which said alarm means comprises means for producing an audible alarm signal when said light from said creosote fire is detected.

6. Creosote fire alarm system as in claims 2 or 4, in which said alarm means comprises means for producing a visible alarm signal when said creosote temperature reaches said warning temperature.

7. Creosote fire alarm system as in claims 3 or 4, in which said chimney has a hole in a side wall of said chimney, said hole being sized to receive said sensor housing in a snug fit engagement, and wherein said sensor housing is secured to said chimney within said hole, with a portion of said sensor housing projecting into the interior of said chimney.

8. Creosote fire alarm system as in claim 7, in which said sensor housing is substantially cylindrical in form.

9. Creosote fire alarm system as in claims 3 or 4, in which said creosote fire light sensor means is a photocell.

10. Creosote fire alarm system as in claim 9, in which said sensor housing further comprises means for sealing said sensor housing from chimney effluents for protection of said photocell while yet allowing said light from said creosote fire to enter said sensor housing to reach the surface of said photocell.

11. Creosote fire alarm system as in claim 4, in which said creosote temperature sensor means is a thermistor.

12. Creosote fire alarm system as in claims 3 or 4, in which said circuit means and said alarm means are at locations remote from said chimney.

13. Creosote fire alarm system as in claim 3, in which said circuit means is electronically connected to said creosote fire light sensor means, by means of wire, said wire being high temperature-resistant wire in the proximity of said chimney.

14. Creosote fire alarm system as in claim 5, in which said alarm means comprises a buzzer.

15. Creosote fire alarm system as in claim 6, in which said alarm means comprises a light emitting diode (LED).

* * * * *